US005596246A

United States Patent [19]

Budzilek et al.

[11] Patent Number: 5,596,246

[45] Date of Patent: Jan. 21, 1997

[54] HIGH CONTRAST TFEL DISPLAY IN WHICH LIGHT FROM THE TRANSPARENT PHOSPHOR LAYER IS REFLECTED BY AN ELECTRODE LAYER AND THE TFEL DIFFUSE REFLECTANCE <ABOUT 2%

[75] Inventors: Russell A. Budzilek, Bridgeport; Dominick L. Monarchie, Norwalk; Myroslaw Podoba, Wallingford; Richard R. Swatson, Trumbull, all of Conn.

[73] Assignee: Northrop Grumman Corporation, Los Angeles, Calif.

[21] Appl. No.: 490,438

[22] Filed: Jun. 12, 1995

Related U.S. Application Data

[63] Continuation of Ser. No. 997,271, Dec. 23, 1992, abandoned.

[51] Int. Cl.[6] ..... H01J 1/62; H01J 63/04

[52] U.S. Cl. ..... 313/502; 313/506; 313/509

[58] Field of Search ..... 313/502, 506, 313/509, 4, 896, 218

[56] References Cited

U.S. PATENT DOCUMENTS

| | | | |
|---|---|---|---|
| 4,599,538 | 7/1986 | Hidler et al. | 313/512 |
| 4,602,189 | 7/1986 | Panicker | 313/506 |
| 4,668,582 | 5/1987 | Matsuoka et al. | 313/509 |
| 4,870,322 | 9/1989 | Matsudaira et al. | 313/506 |
| 4,896,218 | 1/1990 | Vick | 359/601 |
| 4,897,319 | 1/1990 | Sun | 313/509 |
| 4,963,788 | 10/1990 | King et al. | 313/509 |
| 4,983,880 | 1/1991 | Abdalla et al. | 313/506 |
| 5,099,172 | 3/1992 | Taguchi et al. | 313/502 |

FOREIGN PATENT DOCUMENTS

| | | |
|---|---|---|
| 0159531 | 10/1985 | European Pat. Off. . |
| 0483783 | 6/1992 | European Pat. Off. . |
| WO9326139 | 12/1993 | WIPO . |

OTHER PUBLICATIONS

Marvin F. Higgins, "High–Quality Electroluminescent Display for a Personal Workstation", Hewlett–Packard Journal, Oct. 1985.

Gregory, O. J., Zeto, R. J., Hydkowian, E., Burbank, K. A.; "Fabrication of High–Conductivity, Transparent Electrodes With Trenched Metal Bus Lines", J. Electrochem. Soc., vol. 138, No. 7, Jul. 1991; pp. 2070–2075.

Tiku, S. K., "High–Contrast Dark–Field TFEL Display"; Proceedings of the SID, vol. 31/1, 1990; pp. 37–40.

Dobrowolski, J. A., Sullivan, B. T., Bajcar, R. C.; "Optical Interference, Contrast–Enhanced electroluminescent Device"; Applied Optics, vol. 31, No. 28, 1 Oct. 1992.

*Primary Examiner*—Anita Pellman Gross
*Assistant Examiner*—Walter J. Malinowski
*Attorney, Agent, or Firm*—Walter G. Sutcliff

[57] ABSTRACT

A display system (25) includes an enhanced specularity multi-layer thin film electroluminescent (TFEL) panel (26) and circular polarizer filter (27) which combine to provide a high contrast TFEL display. The enhanced specularity is obtained by increasing the rate the phosphor layer of the panel is deposited which results in a smoother, more specular surface. The increased specularity of the panel (26) provides a darker display background, and therefore higher contrast.

5 Claims, 2 Drawing Sheets

HIGH CONTRAST TFEL DISPLAY IN WHICH LIGHT FROM THE TRANSPARENT PHOSPHOR LAYER IS REFLECTED BY AN ELECTRODE LAYER AND THE TFEL DIFFUSE REFLECTANCE <ABOUT 2%

This application is a Continuation of Ser. No. 07/997,271 filed Dec. 23, 1992, now abandoned.

TECHNICAL FIELD

This invention relates to electroluminescent display panels and more particularly to high contrast high specularity electroluminescent display panels.

BACKGROUND ART

Thin film electroluminescent (TFEL) display panels offer several advantages over older display technologies such as cathode ray tubes (CRTs) and liquid crystal displays (LCDs). Compared with CRTs, TFEL display panels require less power, provide a larger viewing angle, and are much thinner. Compared with LCDs, TFEL display panels have a larger viewing angle, do not require auxiliary lighting, and can have a larger display area.

FIG. 1 shows a conventional TFEL panel 10. The TFEL panel has a glass panel 11, a plurality of transparent electrodes 12, a first layer of a dielectric 13, a phosphor layer 14, a second dielectric layer 15, and a plurality of metal rear electrodes 16 perpendicular to the transparent electrodes 12. The transparent electrodes 12 are typically indium-tin oxide (ITO) and the metal electrodes 16 are typically Al. The dielectric layers 13, 15 to protect the phosphor layer 14 from excessive dc currents. When an electrical potential, such as about 200V, is applied between the transparent electrodes 12 and the metal electrodes 16, electrons tunnel from one of the interfaces between the dielectric layers 13, 15 and the phosphor layer 14 into the phosphor layer where they are rapidly accelerated. The phosphor layer 14 typically comprises ZnS doped with Mn. Electrons entering the phosphor layer 14 excite the Mn causing the Mn to emit photons. The photons pass through the first dielectric layer 13, the transparent electrodes 12, and the glass panel 11 to form a visible image.

Although current TFEL panels are satisfactory for some applications, more advanced applications require brighter higher contrast panels, larger panels, and sunlight viewable panels. One approach in attempt to provide adequate panel contrast under high ambient illumination is the use of a circular polarizer filter which reduces ambient reflected light. A circular polarizer filter operates best with a TFEL panel which is very specular. If the specularity of the metal rear aluminum electrodes 16 can be increased, then the efficiency of the circular polarizer filter will also increase.

It is well known in the art that the specularity of an object is directly inverse to the diffuse reflectance of that object. Thus, as the specularity of the panel increases, the diffuse reflectance decreases.

DISCLOSURE OF THE INVENTION

An object of the present invention is to reduce the reflection of ambient light and enhance the contrast of a TFEL panel to provide a sunlight viewable TFEL panel.

According to the present invention, the layered structure of a TFEL panel includes a layer of phosphor which is deposited using thermal evaporation at a rate which is at least 50 Angstroms per second to enhance the specularity of the panel (e.g. decrease the diffuse reflectance of the panel).

According to another aspect of the present invention, a display system includes an enhanced specularity TFEL panel and a circular polarizer filter.

When circularly polarized light from the filter strikes a specular surface the direction of the polarization (i.e., either clockwise or counter clockwise) is reversed and this light can no longer pass back through the linear polarizer plate which is an integral part of the circular polarizer filter. Therefore, the greater the specularity (e.g. the lower the diffuse reflectance) of the electroluminescent panel the less reflected light which passes back through the circular polarizer filter and hence the greater the contrast of the display panel.

The enhanced specularity TFEL display of the present invention provides improved display contrast and is comfortably viewable in elevated ambient lighting conditions. These and other objects, features and advantages of the present invention will become more apparent in light of the following detailed description of a preferred embodiment thereof, as illustrated in the accompanying drawings.

BEST MODE FOR CARRYING OUT THE INVENTION

Figure 2:
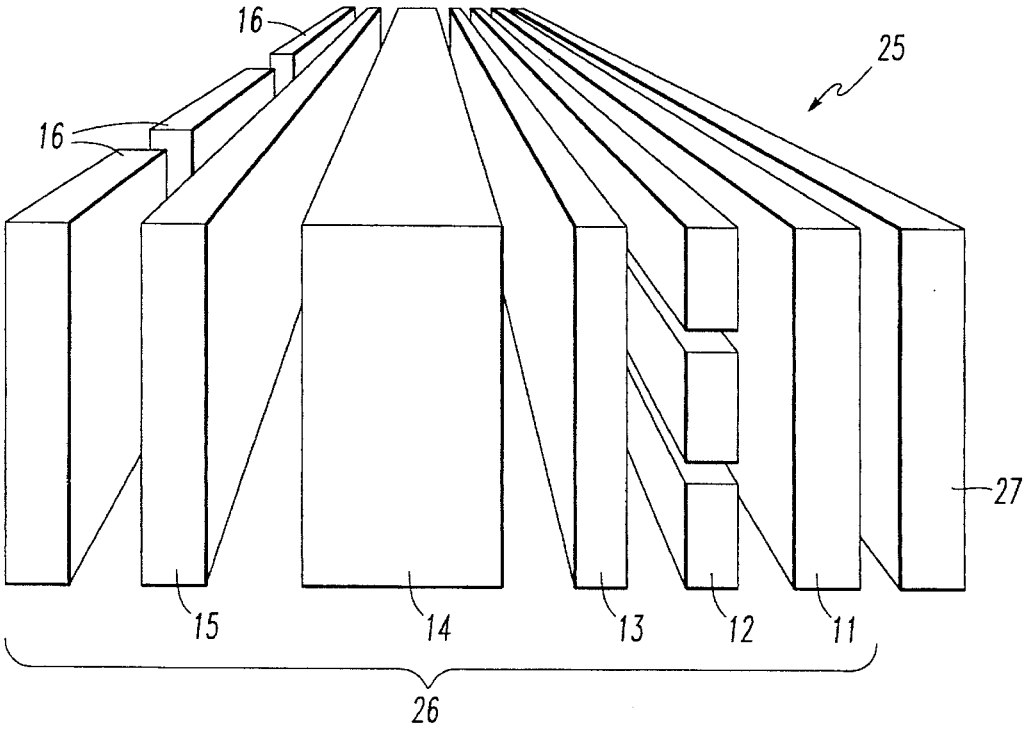
FIG. 2 is an illustration of an enhanced contrast TFEL display system according to the present invention including an increased specularity TFEL panel and a circular polarizer filter.

Referring to FIG. 2, a display system 25 according to the present invention includes a highly specular AC driven thin film electroluminescent (TFEL) panel 26 and a circular polarizer filter 27. The filter 27 has a transmission of 30%–40% preferably about 37%, and an anti-reflection coating which provides about a 0.2% reflectivity. As known, a circular polarizer filter typically includes a linear polarizer and a quarter wave plate such that non-polarized light is first linearly polarized by the linear polarizer and then input to the quarter wave plate which circularly polarizes the light.

Figure 1:
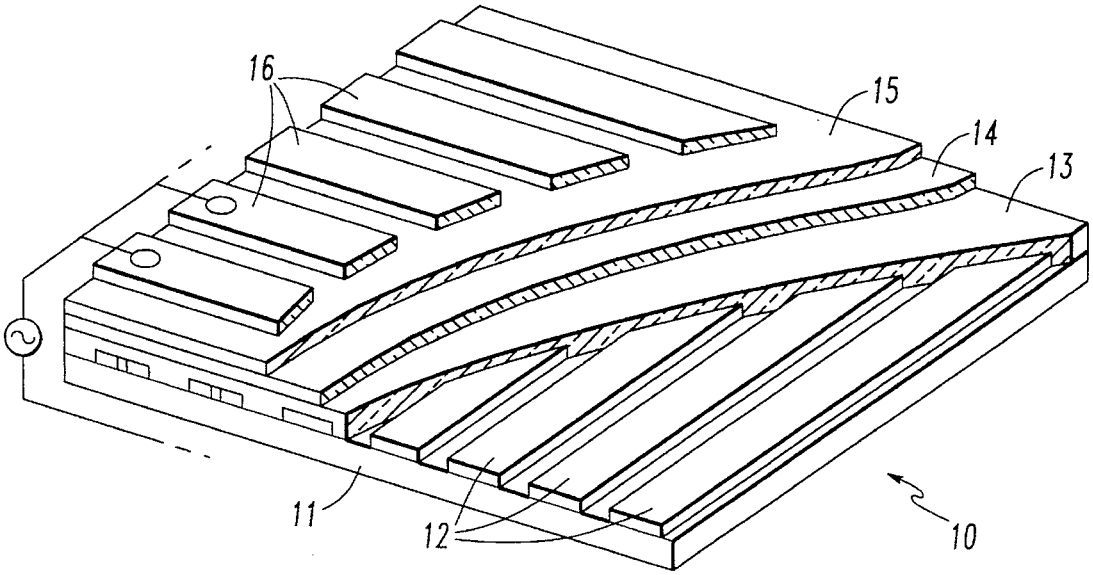
FIG. 1 is an illustration of a partial sectional view of the layered structure of an AC thin film electroluminescent (TFEL) panel.

The layered structure of the highly specular panel 26 and the panel 10 of FIG. 1 are essentially the same and therefore similar layers will retain the same numerical designation.

The first step in making a TFEL panel 26 like the one shown in FIG. 2 is to deposit a layer of a transparent conductor on a suitable glass panel 11. The glass panel 11 can be any high temperature glass that can withstand the phosphor anneal step described below. For example, the glass panel can be a borosilicate glass such as Corning 7059 (Corning Glassworks, Corning, N.Y.). The transparent conductor can be any suitable material that is electrically conductive and has a sufficient optical transmittance for a desired application. For example, the transparent conductor can be ITO, a transition metal semiconductor that comprises about 10 mole percent In, is electrically conductive, and has an optical transmittance of about 85% at a thickness of about 200 nm. The transparent conductor can be any suitable thickness that completely covers the glass and provides the desired conductivity. Glass panels on which a suitable ITO layer has already been deposited can be purchased from Donnelly Corporation (Holland, Mich.). The remainder of the procedure for making a TFEL display of the present invention will be described in the context of using ITO for the transparent electrodes 12. One skilled in the art will recognize that the procedure for a different transparent conductor would be similar.

ITO electrodes 12 can be formed in the ITO layer by a conventional etch-back method or any other suitable method. For example, parts of the ITO layer that will become the ITO electrodes 12 can be cleaned and covered with an etchant-resistant mask. The etchant-resistant mask can be made by applying a suitable photoresist chemical to the ITO layer, exposing the photoresist chemical to an appropriate wavelength of light, and developing the photoresist chemical. A photoresist chemical that contains 2-ethoxyethyl acetate, n-butyl acetate, xylene, and xylol as primary ingredients is compatible with the present invention. One such photoresist chemical is AZ 4210 Photoresist (Hoechst Celanese Corp., Somerville, N.J.). AZ Developer (Hoechst Celanese Corp., Somerville, N.J.) is a proprietary developer compatible with AZ 4210 Photoresist. Other commercially available photoresist chemicals and developers also may be compatible with the present invention. Unmasked parts of the ITO are removed with a suitable etchant to form channels in the ITO layer that define sides of the ITO electrodes 12. The etchant should be capable of removing unmasked ITO without damaging the masked ITO or glass 11 under the unmasked ITO. A suitable ITO etchant can be made by mixing about 1000 ml $H_2O$, about 2000 ml HCl, and about 370 g anhydrous $FeCl_3$. This etchant is particularly effective when used at about 55° C. The time needed to remove the unmasked ITO depends on the thickness of the ITO layer. For example, a 300 nm thick layer of ITO can be removed in about 2 minutes. The sides of the ITO electrodes 12 should be chamfered, as shown in the figures, to ensure that the phosphor layer 14 can adequately cover the ITO electrodes. The size and spacing of the ITO electrodes 12 depend on the dimensions of the TFEL display. For example, a typical 12.7 cm (5 in) high by 17.8 cm (7 in) wide display can have ITO electrodes 12 that are about 30 nm thick, about 250 μm (10 mils) wide, and spaced about 125 μm (5 mils) apart. After etching, the etchant-resistant mask is removed with a suitable stripper, such as one that contains tetramethylammonium hydroxide. AZ 400T Photoresist Stripper (Hoechst Celanese Corp.) is a commercially available product compatible with the AZ 4210 Photoresist. Other commercially available strippers also may be compatible with the present invention.

The dielectric layers 13, 15 can be deposited by any suitable conventional method, including sputtering or thermal evaporation. The two dielectric layers 13, 15 can be any suitable thickness, such as about 80 nm to about 250 nm thick, and can comprise any dielectric capable of acting as a capacitor to protect the phosphor layer 14 from excessive currents. Preferably, the dielectric layers 13, 15 will be about 200 nm thick and will comprise SiON.

The phosphor layer 14 can be any conventional TFEL phosphor, such as ZnS doped with less than about 1% Mn. According to the present invention the phosphor layer is deposited at a rate which is at least 50 Angstroms per second (e.g., 50–100 Angstroms/sec) in order to provide a smoother layer which enhances the specularity of the phosphor layer and thus the specularity of the panel 26. The phosphor layer 14 can be about 5000–8000 Angstroms thick (i.e., 500–800 nm), and preferably about 5000 Angstroms deposited at a rate of 50 Angstroms/second.

After depositing the phosphor layer 14 followed by the second dielectric layer 15, the panel should be heated to about 500° C. for about 1 hour to anneal the phosphor. Annealing causes Mn atoms to migrate to Zn sites in the ZnS lattice from which they can emit photons when excited.

After annealing the phosphor layer 14, the metal electrodes 16 are formed on the second dielectric layer 15 by any suitable method, including etch-back or lift-off. The metal electrodes 16 can be made from any highly conductive metal, such as Al. As with the ITO electrodes 12, the size and spacing of the metal electrodes 16 depend on the dimensions of the display. For example, a typical 12.7 cm (5 in) high by 17.8 cm (7 in) wide TFEL display can have metal electrodes 16 that are about 100 nm thick, about 250 μm (10 mils) wide, and spaced about 125 μm (5 mils) apart. The metal electrodes 16 should be perpendicular to the ITO electrodes 12 to form a grid.

The present invention is based on the fact that when circularly polarized light strikes a specular surface, the direction of the circular polarization (i.e., either clockwise or counter clockwise) is reversed and this light can no longer pass back through the linear polarizer plate which is an integral part of a circular polarizer filter. Ambient light incident on the panel 1) travels through the glass layer, the transparent electrode layer, the first dielectric layer, the phosphor layer and the second dielectric layer; 2) reflects off of the metal electrodes where it is circularly polarized; and 3) travels back through the second dielectric layer, the phosphor layer, the first dielectric layer, the transparent electrode layer and the glass layer. Therefore, the amount of ambient light incident on the surface of the panel which reflects back to the observer can be reduced with a highly specular TFEL panel and a circular polarizer filter. Increasing the specularity of the panel increases the efficiency of the circular polarizer filter and results in improved display contrast since less ambient light is reflected. An example of the improvement in contrast provided by the present invention over the prior art is now in order.

Figure 3:
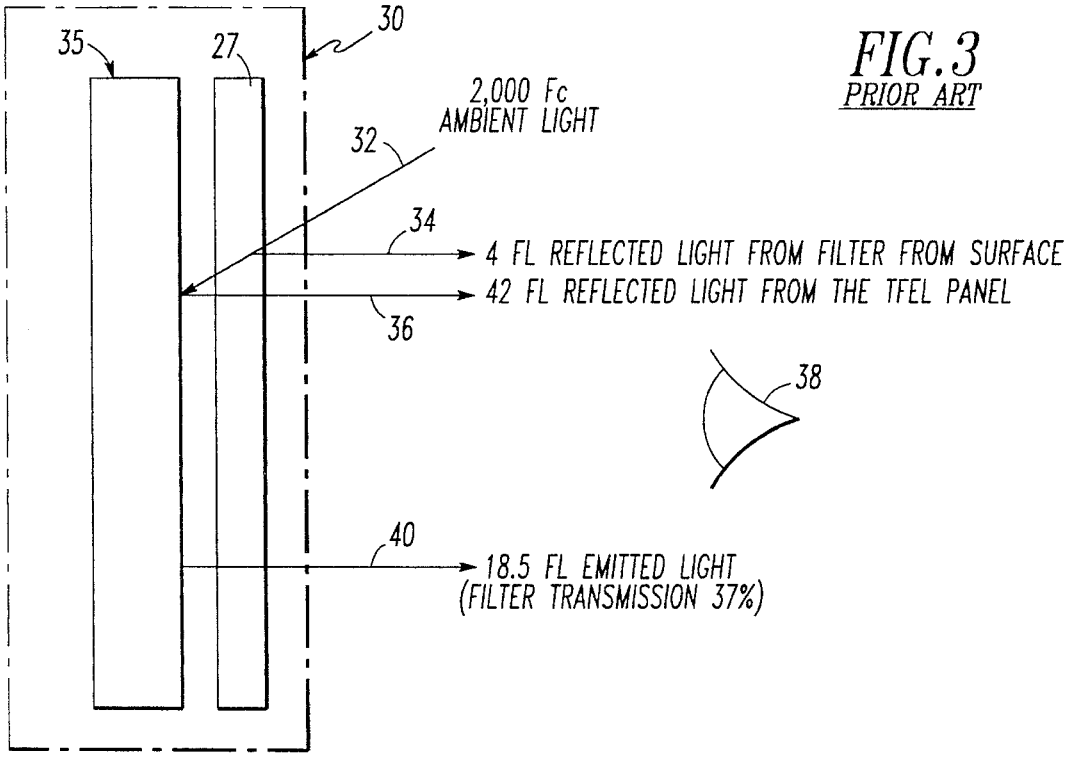
FIG. 3 PRIOR ART
FIG. 3 is a diagram illustrating ambient light reflected off a prior art TFEL display panel and a circular polarizer filter, and light emitted from an illuminated pixel of the prior art TFEL display panel all directed towards a viewer.

FIG. 3 is a functional illustration of a conventional prior art TFEL display system 30 within an ambient light environment of 2,000 foot-candles (fc) of light. Ambient light 32 strikes the circular polarizer filter 27 at a thirty degree angle taken from a line normal to the plane of the face of the filter 27 resulting in four foot-lamberts (fl) of light 34 being reflected off the face of the filter 27. The ambient light 32 is also reflected off a conventional TFEL panel 35 resulting in about forty-two fl of light 36 being reflected towards the viewer 38. The TFEL panel 35 also provides about 50 fl of light emitted from an illuminated pixel. However, due to the 37% transmission of the filter only about 18.5 fl of light 40 is emitted from the display system 25.

Contrast is the measure of the panel's reflected light 34, 36 compared to the emitted light 40, contrast is defined as:

$$\text{Contrast} = \frac{\text{panel emitted light} + \text{ambient reflected light}}{\text{ambient reflected light}} \qquad \text{[EQ. 1]}$$

Since the panel emitted light is 18.5 fl, and the reflected light components from the filter and panel are 4 fl and 42 fl respectively, the contrast of the prior art panel 25 is:

$$\text{Prior art panel contrast} = \frac{18.5 + 42 + 4}{42 + 4} = 1.4 \quad \text{[EQ. 2]}$$

Figure 4:
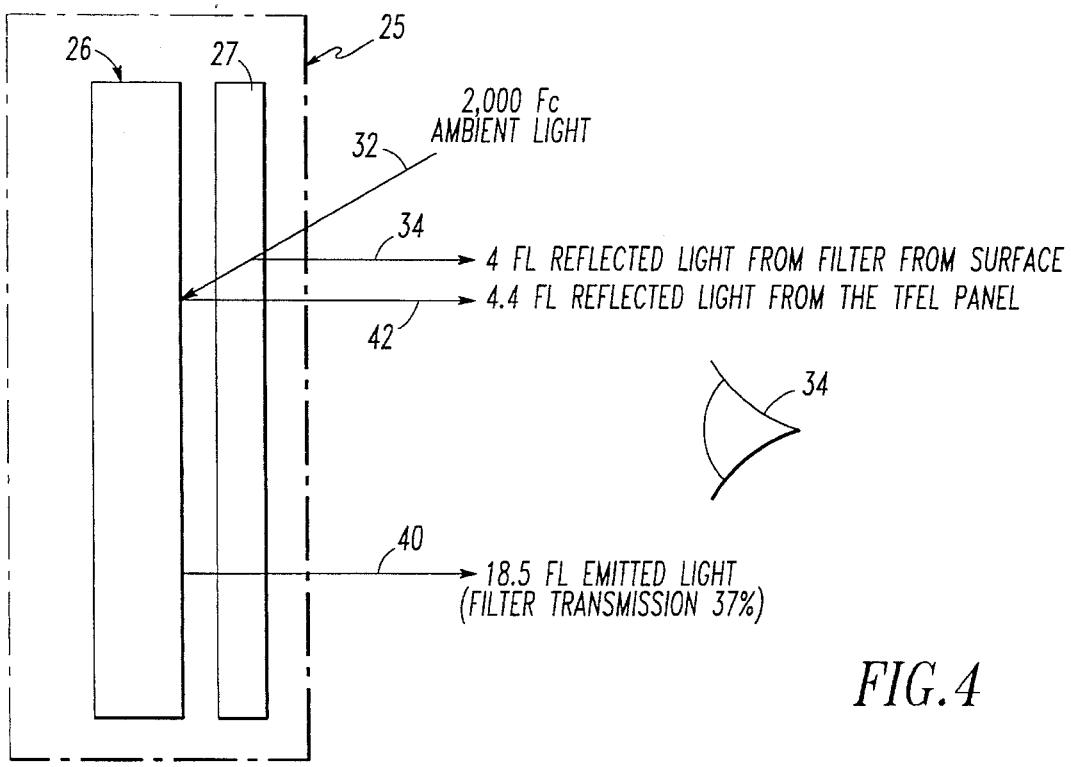
FIG. 4 is a diagram illustrating ambient light reflected off the increased specularity display panel and the circular polarizer filter both of FIG. 2, and light emitted from an illuminated pixel of the increased specularity panel all directed towards the viewer.

FIG. 4 illustrates an enhanced display system 25 of the present invention having the highly specular TFEL panel 26 and the circular polarizer filter 27. Note, the display a system of FIG. 4 is substantially the same as the display system in FIG. 3 and therefore where ever possible elements which are essentially the same will retain the same numerical designation. The highly specular panel 26 has an active area of 3.5"×4.7" with 320 ITO column electrodes each 2000 angstroms thick and sputter deposited, and 240 Al row electrodes each 1500 angstroms thick and deposited by thermal evaporation. The phosphor layer is 8000 angstroms thick and deposited by thermal evaporation at a rate of 50 angstroms per second. The dielectric layers were each RF sputtered 2000 angstroms thick SiON. The display system 25 is within an ambient lighting environment of 2000 fc, which results in four fl of reflected light 34 off the filter 27 front surface. The ambient light 32 is also reflected off the highly specular TFEL panel 26 with a net result that only 4.4 fl of reflected light 42 passes through the circular polarizer filter. Attention is drawn to the fact that the reflected light 36 (FIG. 3) from the prior art TFEL panel 35 was 42 fl in comparison to only 4.4 fl of reflected light 42 (FIG. 4) from the highly specular TFEL panel 26 of the present invention. As a result, substituting the numbers associated with the enhanced display system 25 into Eq. 1 results in a display contrast of:

$$\text{enhanced specularity panel contrast} = \frac{18.5 + 4 + 4.4}{4 + 4.4} \quad \text{[EQ. 3]}$$

Therefore, the present invention provides about a 2-to-1 improvement in contrast over the conventional specular display panel of FIG. 3. In terms of diffuse reflectance, the highly specular display panel of the present invention has a diffuse reflectance on the order of only 2%, whereas the prior art panel exhibits diffuse reflectance of 15–20%.

The contrast improvement associated with the enhanced display system 25 is primarily due to the improvement in the specularity of the TFEL panel 26 and the resulting increase in efficiency which the circular polarizer filter provides. Enhancing the specularity of the TFEL panel 26 increases the efficiency of the circular polarizer filter 27 and results in improved display contrast since less light is reflected.

Incidently it will be appreciated that if the display system of the present invention will be used outside for prolonged periods, an ultraviolet (UV) filter should be placed in front of the circular polarizer 27 to ensure that UV light does not destroy the polarizing properties of the circular filter.

Although the invention has been shown and described with respect to a preferred embodiment thereof, it should be understood by those skilled in the art that various other changes, omissions, and additions may be made to the embodiments disclosed herein, without departing from the spirit and scope of the present invention.

We claim:

1. An electroluminescent display having a circular polarizing filter for accepting ambient light and an electroluminescent panel adjacent said filter for reflecting light passed by said filter, said electroluminescent panel comprising:

a transparent phosphor layer for passing light passed by said filter; and an electrode layer for reflecting light passed by said transparent phosphor layer, whereby the reflected light passes through said transparent phosphor layer towards said filter such that said electroluminescent panel has a diffuse reflectance less than about 2%.

2. The electroluminescent display of claim 1 wherein said transparent phosphor layer has a diffuse reflectance less than about 2%.

3. The electroluminescent display of claim 1 wherein said display has a contrast greater than about 3 in an ambient light greater than about 2000 fc.

4. The electroluminescent display of claim 1 wherein said phosphor layer is deposited at greater than about 50 A/s.

5. The electroluminescent display of claim 1 wherein said phosphor layer is deposited at greater than 50 A/s.

* * * * *